United States Patent [19]

YaSenka

[11] 4,334,557

[45] Jun. 15, 1982

[54] CANNING UTENSIL

[76] Inventor: Kathryn H. YaSenka, 1409 Elk St., Franklin, Pa. 16323

[21] Appl. No.: 146,296

[22] Filed: May 5, 1980

[51] Int. Cl.[3] ..... B65B 3/04

[52] U.S. Cl. ..... 141/98; 141/331; 30/302; 30/304

[58] Field of Search ..... 141/98, 331-345, 141/1; 241/95; 30/117, 114, 299, 302, 303, 304, 305

[56] References Cited

U.S. PATENT DOCUMENTS

| | | | |
|---|---|---|---|
| 48,149 | 6/1865 | Bennett . | |
| D. 149,622 | 5/1948 | Dougherty | 30/302 |
| 205,223 | 6/1878 | Weatherbee et al. . | |
| 1,097,479 | 5/1914 | Starr . | |
| 1,112,991 | 10/1914 | Dufner . | |
| 1,746,979 | 2/1930 | Woolley . | |
| 2,242,607 | 5/1941 | Ehlke . | |
| 2,331,068 | 10/1943 | Di Pietro . | |
| 2,508,944 | 5/1950 | Harney | 141/98 |
| 2,679,688 | 6/1954 | Buschman | 30/117 |
| 2,824,588 | 2/1958 | Lyon et al. . | |

FOREIGN PATENT DOCUMENTS

| | | | |
|---|---|---|---|
| 48246 | 4/1940 | Netherlands | 241/95 |
| 48438 | 7/1910 | Switzerland | 30/302 |
| 303219 | 2/1955 | Switzerland | 30/305 |

OTHER PUBLICATIONS

Front Cover of "Revised Edition", Freezing and Canning Cook Book by Farm Journal.

*Primary Examiner*—Houston S. Bell, Jr.
*Attorney, Agent, or Firm*—Michael R. Swartz

[57] ABSTRACT

A canning utensil which is used in filling canning jars with food products in sliced form is provided with a hollow, cup-shaped body and an upper cutter assembly mounted adjacent the top opening of the body of the utensil. By using the canning utensil, a food product to be canned may first be severed into slices and then funneled into the canning jar without intervention being necessary to handle the slices. This is accomplished by manually pushing the food product down through the blades of the cutter assembly. As the severed product slices emerge from between the blades, they slide downward through the interior of the cup-shaped body of the utensil along converging paths and are deposited into the canning jar on which the utensil is resting. In alternative embodiments, the cutter blades can take on several configurations and can be fixedly mounted as well as removably mounted to the utensil.

10 Claims, 7 Drawing Figures

CANNING UTENSIL

BACKGROUND OF THE INVENTION

The present invention relates to home canning devices, and, more particularly, is directed to a utensil used in canning of foods which severs the food to be canned into slices and then funnels the severed food slices into a canning jar.

In recent years, home preserving of foods has gained increased popularity. With rising food costs and a more keen awareness of the nutritutional value of food, more and more people are turning to growing their own fruits and vegetables and then preserving them by canning, freezing, drying, and the like as was the custom with their forefathers.

In the home canning operation, the food is placed into containers, such as glass canning jars, and then the jar of food is placed into a pressure cooker or cold packer for a given amount of time so as to seal the lid and preserve the food for storage. Many foods, especially fruits and vegetables are processed in this well known manner. Often-times it is desirable that the food be cut into smaller pieces or slices before it is placed into a canning jar, for instance, peaches are often sliced and the same can be said for red beets.

Customarily, the home canner uses a common paring knife for cutting up these foods; however, there are many different types of food slicers, choppers and dicers on the market which have been designed to perform a specific function on a given food. An example of one such device is shown in U.S. Pat. No. 48,149 which is directed to a machine for coring, slicing and stringing apples. More specifically, this machine includes a base plate that supports a cutter assembly and a fulcrum lever mechanism which is positioned above the cutter assembly. An apple is set on the cutter assembly, and as the lever is moved in a downward direction, the apple is forced through the cutter blades which slices the apple as well as coring the same. A somewhat similar machine is shown in U.S. Pat. No. 2,824,588 which is directed to a device for slicing melons. The melon is placed in a holding bowl or craddle wherein a multi-blade knife assembly is brought down over the melon and passed therethrough to cut the melon into several evenly and uniformily divided slices.

U.S. Pat. No. 205,223 shows another type of vegetable cutter wherein the vegetables to be cut are placed into a hopper which has a cutter assembly supported in the bottom thereof. A follower, interconnected to a handle by a series of gears, is placed on the top of the vegetables, and thus, as the handle is turned, the follower is screwed down against the vegetables, feeding the vegetables down through the cutter assembly.

The Starr patent (U.S. Pat. No. 1,097,479) shows yet another type of vegetable cutter. Shown is a frame which is adapted to be positioned across the upper end of a tub, bucket or other receptacle and across which is stretched a thin metallic ribbon which operates as a knife for cutting the vegetables as they are forced downwardly and across the ribbon. This device is commonly known as a cabbage slaw cutter. A similar such device is seen in U.S. Pat. No. 1,112,991.

Yet another prior art cutting device is represented by U.S. Pat. No. 1,746,979. The disclosed device includes a cup-shaped member 10 provided with a belled mouth 11 and a cutter assembly positioned adjacent the bottom of member 10. Beneath the cutter assembly, a receptacle 31 is disposed to receive the cut product as same is forced down through the cutter assembly by a pressing plug 10'.

Still another vegetable cutter device of more recent vintage is illustrated in U.S. Pat. No. 2,242,607. The object of this invention was to provide a device wherein whole cooked vegetables could be cut into strips and cooked sliced vegetables could be cut into cubes without removing the same from the cooking utensil wherein they have been cooked, the cutting being done by pressing through the vegetables a crosswork of fine but strong wires which are tightly strung upon a rigid frame.

Another utensil quite commonly used in the home canning operation is a canning funnel such as the one shown in the Revised Edition of the Freezing & Canning Cookbook put out by Farm Journal (Library of Congress Catalog Card Number 72-91947). Such canning funnels are used with both the wide mouth and small neck variety of canning jars and functions not only in assisting the filling of the jars with the food products but also facilitates the pouring of liquids, such as, syrups into the jars.

Besides the canning funnel, there are other types of funnels on the market such as the one shown in U.S. Pat. No. 2,331,068. The disclosed device is a combination utensil which functions as a funnel as well as a strainer. This combination utensil was specifically designed for filling nursing bottles and basically includes a funneling structure with a strainer supported within a tubular neck which is secured to the lower portion of the structure and which defines the lower opening.

All of the above-described prior art cutting devices serve the specific intended purpose for which they were designed, some of these devices being more complicated and more costly than others. In addition, the prior art canning funnel adequately serves its intended purpose. Thus, it can be generally stated that, up to now, the food cutting devices have been directed solely to that function, whereas, the canning funnel has been directed to its intended function, separate from the function of the food cutting devices.

SUMMARY OF THE INVENTION

Accordingly, one of the principal objects of the present invention is to provide a utensil for use in the home canning of foods which serves both as a funneling device as well as a severing device whereby food to be canned can be easily severed into smaller pieces or slices and then funneled into a canning jar.

Another object of the present invention is to provide a canning utensil which is adapted to be partially inserted into the mouth opening of a standard canning jar and which rests on the peripherial edge of the jar in a supportive position as it performs its desired function.

Still another object is to provide a canning utensil as set forth above wherein the cutter assembly can be easily removed from the funneling structure for interchanging one cutter assembly for another whereby the food product may be severed into different desired sizes and shapes.

Yet another object of the present invention is to provide a canning utensil which is of simple and sturdy construction, inexpensive to manufacture, safe in operation and easily cleaned.

In furtherance of these and other objects, the present invention sets forth a utensil for use in home canning of food products which facilitates the severing of the food product into smaller units and the filling of a canning jar with the severed food units. More particularly, the utensil comprises a formed hollow generally cylindrical main body having an upper section with an upper peripheral edge that defines a top opening and with an integral lower section that defines a bottom opening. The utensil is cup-shaped such that food pieces placed into the top opening will slide down along convergent paths through the hollow interior of the utensil body and out through the bottom opening and into a canning jar on which the utensil is restably supported.

The utensil further includes severing means extending across the upper section of the main body adjacent the top opening for severing food into smaller slices or pieces as same is manually forced down through the top opening.

In the preferred embodiment, the severing means includes a plurality of elongated blades extending across the top opening and secured to the upper peripheral edge of the upper section. Preferably, the blades are parallel and are equally spaced.

In modified embodiments of the present invention, the severing means takes on different sizes and shapes so as to sever the food product into desired configurations. Additionally, the severing means is removably supported within the top opening and on the upper section of the main body so as to facilitate the interchangeability of one severing mechanism for another.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 4 is a side elevational view in cross section whereas FIG. 5 is a top plan view.

DETAILED DESCRIPTION OF THE INVENTION

Figure 1:
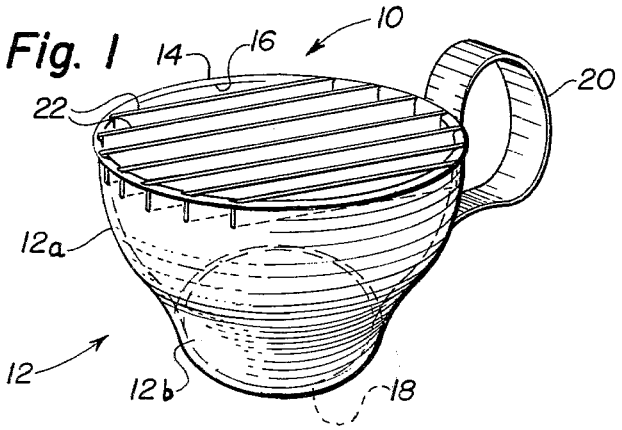
FIG. 1 is a perspective view of the canning utensil in accordance with the principles of the present invention.
Figure 2:
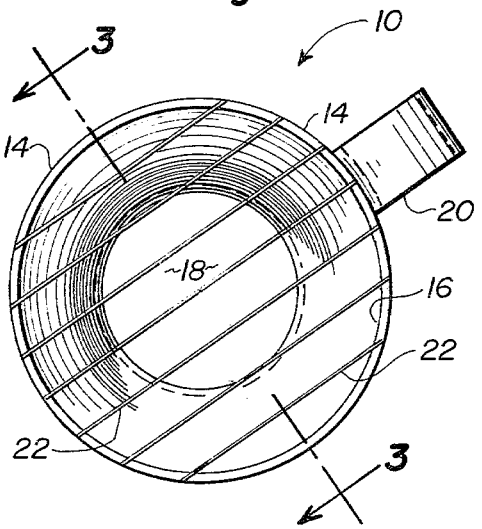
FIG. 2 is a top plan view of the canning utensil as seen in FIG. 1.
Figure 3:
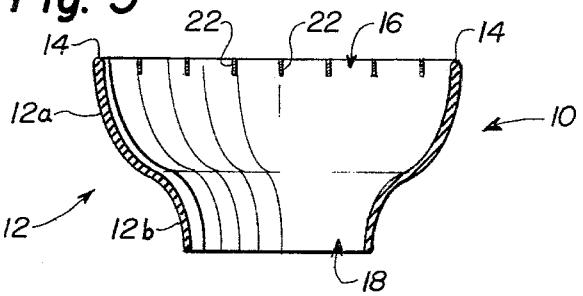
FIG. 3 is a cross-sectional view of the canning utensil as taken along lines 3—3 of FIG. 2.

Referring now to the drawings, and particularly to FIGS. 1-3, there is shown a canning device, being indicated generally by the numeral 10, which incorporates the principles of the present invention. The utensil 10 includes a hollow, generally cylindrical, main body 12 which is preferably formed from a suitable metal, such as, stainless steel or aluminum, or, in the alternative, may be formed from a relatively rigid plastic formable material.

The upper section **12*a* of the main body 12 is generally cup-shaped having its mouth or upper peripheral edge 14 defining a top opening 16. The top opening 16 is of a diameter generally greater than the diameter of the mouth opening of a canning jar. Integrally formed to and below the upper section 12*a* is a lower neck section 12*b*, which is generally cylindrical in shape, with its lower peripheral edge defining a bottom opening 18 to the main body 12. The diameter of the bottom opening 18 is less than the diameter of the top opening 16 and less than the mouth opening of a canning jar (not shown) such that the lower neck section 12*b*** can be inserted into the mouth of the canning jar.

The upper section **12*a* is shaped such that the inside curved wall slopes progressively radially inwardly toward the central axis of body 12 from the upper peripheral edge 14 to the meeting or junction of the lower neck section 12*b* with the upper section 12*a*. The configuration is such that food products placed into the top opening 16 will slide and fall along converging paths downwardly through the bottom opening 18. Further, in the preferred embodiment, the lower neck section 12*b* is generally cylindrical being equally spaced from the central axis of body 12**; however, this section could also slope radially inwardly.

Mounted on the outer or exterior face of the upper section **12*a* is a conventional handle 20 which facilitates the placement of utensil 10** on a canning jar.

The utensil 10 further includes a cutter assembly which, in the preferred embodiment, is represented by a plurality of metal blades 22 that extend across the top opening 16 and are suitably supported on the upper peripheral edge 14 of main body 12. The blades 22 are elongated thin metal strips and preferably are parallel and equally spaced from one another (see FIG. 3). Further, it has been found that in some operations, such as in slicing peaches, it is desirable that the blades 22 have a serrated edge.

As easily understood by those skilled in the art of home canning, the canning utensil 10 is set on a canning jar by inserting the lower neck section **12*b* into the open mouth of the jar such that the lower outer curved portion of the upper section 12*a* rests on the peripheral edge of the jar. The housewife or canning person takes a food product, such as a peeled peach that has been destoned, and places it on the blades 22, and then, by manually forcing the peach through the cutter blades 22, thereby severing the peach into several pieces or slices. The peach slices drop downwardly and are funneled through the bottom opening 18** and deposited into the canning jar.

Figure 5:
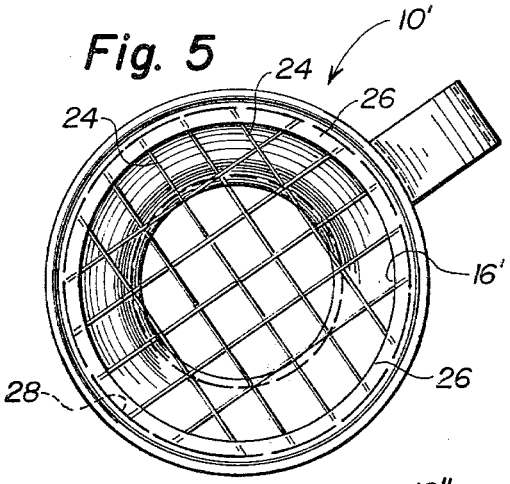
FIGS. 4 and 5 show an alternative embodiment of the canning utensil in accordance with the principles of the present invention with the cutter assembly being removably supported on an internal annular rib positioned adjacent the top opening and with the cutter assembly being represented by a series of crosswork wires secured to an annular frame ring.
Figure 4:
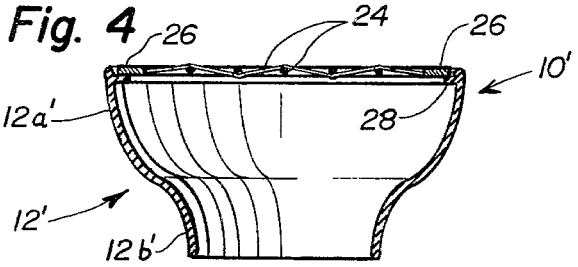

FIGS. 4 and 5 represent an alternative embodiment of the canning utensil in accordance with the principles of the present invention. The modified canning utensil 10' includes a main body 12' substantially identical in shape and form to the main body 12 described above. The cutter assembly in this modified embodiment is illustrated by a series of crosswork wires 24 fastened at their respective ends to an outer ring frame 26. This cutter assembly is removeably supported within the top opening 16' on an internal annular rim 28 secured to the inner face of upper section 12a' of main body 12'. As readily appreciated, such cutter configuration produces square or rectangular cross sectional shaped food product pieces. Furthermore, by such removeable mounting of the cutter assembly, one type of cutter assembly can be easily interchanged for another type of cutter assembly, for example, when it is desired to cut the product into slices rather than rectangular pieces. In some instances it may be desirable to retain the cutter assembly on the main body 12' by using fasteners, such as srews, that extend through the outer ring frame 26 and annular rim 28.

Figure 7:
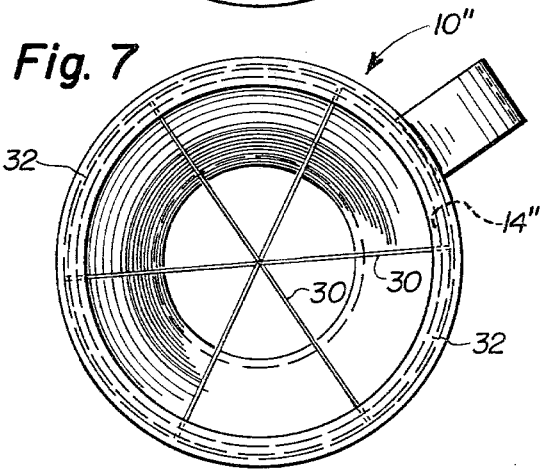
FIGS. 6 and 7 represent another alternative embodiment of the present invention with the cutter assembly being in the form of a plurality of wires arranged so as to cut the food product into wedge shaped pieces. The wires are fastened to a ring frame that has an annular downwardly projecting flange for suitably supporting the cutter assembly on the upper peripheral edge of the main body funneling structure.
Figure 6:
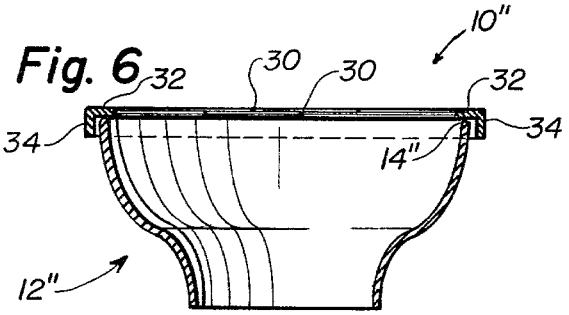

Still another embodiment of the present invention can be seen in FIGS. 6 and 7 wherein the canning utensil 10'' has an identically shaped main body 12''. Here, the cutter assembly is again different than the ones associated with the above two described embodiments. The cutter assembly is represented by fine wires 30 suitably fastened to an outer frame ring 32 which has an annular downwardly projecting flange 34 encircling the ring 32 and which functions to support the cutter assembly on the top peripheral edge 14'' of the main body 12''. The wires 30 are so arranged that the severed food product takes on a wedge shape.

It is thought that the invention and many of its attendant advantages will be understood from the foregoing description and it will be apparent that various changes may be made in form and construction of the canning utensil without departing from the spirit and scope of the invention or sacrificing all of its material advantages, the form hereinbefore described being merely a preferred or exemplary embodiment thereof.

What is claimed is:

1. A canning utensil for use in filling canning jars with food product wherein said utensil serves the dual function of severing the food product and funneling the severed food product into a canning jar, said canning utensil comprising:

(a) a funnel-like body structure having an upper portion with atop opening and a lower portion with a bottom opening adapted to be inserted into the mouth of a canning jar for restably supporting said utensil on said jar, said top opening being of a larger diameter than said bottom opening and said body structure being so shaped to guide food product down from the top opening, through said bottom opening, and into the canning jar; and (b) severing means extending across said upper portion adjacent said top opening for severing the food product into pieces upon insertion of the food product against said severing means whereby the severed food product is then directed down through said body structure and into said canning jar.

2. A canning utensil as defined in claim 1, wherein said severing means includes a plurality of blades adapted to sever a food product.

3. A canning utensil as defined in claim 2, wherein said blades are thin elongated metal knives.

4. A canning utensil as defined in claim 2, wherein said blades are fine wire elements.

5. A canning utensil as defined in claim 2, wherein said plurality of blades are generally parallel.

6. A canning utensil as defined in claim 5, wherein said blades are substantially equally spaced from one another such that the food product when severed is divided into generally equal slices.

7. A canning utensil as defined in claim 1, wherein said upper portion of said body structure has a peripheral edge that defines said top opening and said lower portion is a tubular section that defines said bottom opening, said body structure sloping radially inwardly toward the central axis of said utensil from said upper peripheral edge to said tubular section.

8. A canning utensil as defined in claim 7, wherein said severing means is fixably mounted on said peripheral edge of said body structure.

9. A canning utensil a defined in claim 7, wherein said severing means is removably mounted on said body structure adjacent said top opening.

10. A canning utensil as defined in claim 7, wherein said severing means includes a plurality of blades attached to an outer ring frame, said frame having an annular flange which encircles said ring frame and which is adapted to fit around said upper peripheral edge of said body structure for thereby retaining said blades in a relative position adjacent said top opening.

* * * * *